US012291768B2

(12) United States Patent
Li et al.

(10) Patent No.: US 12,291,768 B2
(45) Date of Patent: May 6, 2025

(54) FAST AGEING METHOD FOR STAMPED HEAT-TREATABLE ALLOYS

(71) Applicant: IMPERIAL INNOVATIONS LIMITED, London (GB)

(72) Inventors: Nan Li, London Greater London (GB); Jinghua Zheng, London Greater London (GB); Kailun Zheng, London Greater London (GB); Jianguo Lin, London Greater London (GB); Catrin Davies, London Greater London (GB)

(73) Assignee: IMPERIAL INNOVATIONS LIMITED, London (GB)

( * ) Notice: Subject to any disclaimer, the term of this patent is extended or adjusted under 35 U.S.C. 154(b) by 0 days.

(21) Appl. No.: 15/749,680

(22) PCT Filed: Aug. 5, 2016

(86) PCT No.: PCT/GB2016/052451
§ 371 (c)(1),
(2) Date: Feb. 1, 2018

(87) PCT Pub. No.: WO2017/021742
PCT Pub. Date: Feb. 9, 2017

(65) Prior Publication Data

US 2018/0223405 A1 Aug. 9, 2018

(30) Foreign Application Priority Data

Aug. 5, 2015 (GB) ..... 1513832

(51) Int. Cl.
*C22F 1/05* (2006.01)
*C22C 21/02* (2006.01)
*C22C 21/06* (2006.01)

(52) U.S. Cl.
CPC ..... *C22F 1/05* (2013.01); *C22C 21/02* (2013.01); *C22C 21/06* (2013.01)

(58) Field of Classification Search
CPC .... C22F 1/002; C22F 1/04; C22F 1/05; C22F 1/06
See application file for complete search history.

(56) References Cited

U.S. PATENT DOCUMENTS 4,861,391 A * 8/1989 Rioja ..... C22F 1/04 148/564
5,728,241 A 3/1998 Gupta et al.
(Continued)

FOREIGN PATENT DOCUMENTS

CN 101168828 A 4/2008
CN 102216484 A 10/2011
(Continued)

OTHER PUBLICATIONS

Hirano et al. "Origin of Guinier-Preston Zones in Alloys." J. Phys. Soc. Japan. vol. 10, p. 587 (Year: 1955).*
(Continued)

*Primary Examiner* — Nicholas A Wang
(74) *Attorney, Agent, or Firm* — Meunier Carlin & Curfman LLC

(57) ABSTRACT

A method is provided for artificially ageing a material, comprising heating the material according to a predefined temperature profile, wherein the temperature profile comprises a variable target temperature; and applying a paint bake cycle to the material.

5 Claims, 3 Drawing Sheets

(56) References Cited

U.S. PATENT DOCUMENTS

| | | | | |
|---|---|---|---|---|
| 2010/0224293 | A1* | 9/2010 | Wang | C22C 21/02 148/698 |
| 2013/0216790 | A1* | 8/2013 | Smeyers | C22C 21/10 148/537 |
| 2018/0251877 | A1* | 9/2018 | Carter | C22F 1/047 |

FOREIGN PATENT DOCUMENTS

| | | | | |
|---|---|---|---|---|
| CN | 103320728 | | * | 9/2013 |
| CN | 103320728 | A | | 9/2013 |
| CN | 104018040 | A | | 9/2014 |
| CN | 103320728 | B | | 5/2015 |
| CN | 106756669 | A | * | 5/2017 |
| GB | 2473298 | A | | 3/2011 |
| JP | H05070907 | A | | 3/1993 |
| JP | 05279822 | A | * | 10/1993 |
| JP | H05279822 | A | | 10/1993 |
| JP | 2012025976 | A | | 2/2012 |
| WO | 2008059242 | A2 | | 5/2008 |
| WO | WO2008059242 | | * | 5/2008 |
| WO | 2010032002 | A1 | | 3/2010 |

OTHER PUBLICATIONS

Koch et al. "The Heat Treatment of the Commercial Aluminum Alloy 7075." J. Heat Treating. vol. 1, No. 2. pp. 3-14 (Year: 1979).*

Shan-Shan Li et al. "Influence of Pre-strain on the Mechanical Properties of A6111-T4P sheet with Bake Hardening." Acta. Metall. Sin. (Engl. Lett.) 28(6) pp. 678-683. (Year: 2015).*

Qian Zhao et al. "Effect of Aging Treatment Technology on Properties of Al—Mg—Si—Cu—Zr—Er Alloy for Auto Sheets." Materials Science Forum. ISSN: 1662-9752. vol. 850, pp. 815-822. (Year: 2016).*

CN 106756669 A. Machine translation of the description. (Year: 2017).*

Fan, X. et al. "Experimental investigation on hot forming-quenching integrated process of 6A02 aluminum alloy sheet." 2013. Materials Science and Engineering A. 573. p. 154-160. (Year: 2013).*

Examination Report in connection to European Application No. 16750243.4, dated Oct. 29, 2019.

Office Action in connection to Chinese Application No. 201680052162.7, dated Sep. 4, 2019, with English Translation.

Examination Report, in connection to European Application No. 16750243.4, dated Jun. 6, 2019.

Ding, L. et al. "Optimization of the pre-aging treatment for an AA6022 alloy at various temperatures and holding times", Journal of Alloys and Compounds, vol. 647, Jun. 10, 2015, pp. 238-244.

Tao, G.H. et al. "The influence of Mg/Si ratio on the negative natural aging effect in Al—Mg—Si", Materials Science and Engineering A: Structural Materials: Properties, Microstructures and Processing, vol. 642, Jul. 2, 2015, pp. 241-248.

Birol, et al. "Restoration of the bake hardening response in a naturally aged twin-roll cast AlMgSi automotive sheet", Scripta Materialia, Elsevier, Amsterdam, NL, vol. 54, No. 12, Jun. 1, 2006, pp. 2003-2008.

International Search Report and Written Opinion dated Oct. 12, 2016, from International Application No. PCT/GB2016/052451, 10 pages.

Feng, J.N. "Effects of pre-aging treatments on the microstructures and properties before and after paint bake cycle for a 6016 aluminum alloy", Journal of Chinese Electron Micorscopy Society, vol. 31, No. 6, 2012 (english abstract).

Combined Search and Examination Report under Sections 17 and 18(3) dated May 27, 2016, from Application No. GB1513832.4, 7 pages.

Second Office Action relating to Chinese Application No. 2016800521627, dated Feb. 21, 2020.

Communication pursuant to Article 94(3) EPC in connection to EP Application No. 16750243.4, dated May 3, 2021.

The American Society For Metals, "Metals Handbook," 1948 Edition, 9 pages.

Vukota Boljanovic, Ph.D. "Sheet Metal Forming Processes and Die Design," Industrial Press, 2004, 9 pages.

* cited by examiner (a) (b)

(a) (b)

FAST AGEING METHOD FOR STAMPED HEAT-TREATABLE ALLOYS

FIELD

The present disclosure relates to ageing processes for manufacturing materials. In particular, but not exclusively, the present disclosure relates to the ageing of materials to improve hardness properties when such materials are formed using a solution heat treatment cold die forming and quenching process.

BACKGROUND

There is an ongoing desire to improve the performance of materials used in manufacturing. For example, in the automotive industry there is a desire to reduce the weight of vehicles while retaining necessary structural properties. This has significant benefits in terms of the vehicle's overall efficiency in use, allowing vehicles which are both cheaper to run and more environmentally sustainable.

To reduce energy consumption and environmental impacts, light weight and relatively low cost aluminium alloys have gained increasing attention in the automotive industry. This is in comparison with the widespread use of steel, for example. However, while the density of steel is around three times greater than that of aluminium, it is also a significantly cheaper material. In order to realise the economic benefits of constructions based on aluminium alloys, it is important that the manufacturing process using such materials is itself efficient.

Conventionally, aluminium alloys which have been treated to achieve suitable material properties have been subsequently formed into desired geometries at low temperature (i.e. room temperature). However, difficulties with this process include the possibility that the aluminium work piece may not be sufficiently ductile and malleable to allow such forming without risk of failure. In order to overcome such issues, extensive research and industrial trials have been performed to fully explore the potential of aluminium alloys in manufacturing lines in order to form high quality parts efficiently.

A new forming process named solution heat treatment cold die forming and quenching (HFQ) process has been developed to form high strength complex-shaped panel components. This process can integrate the heat treatment provided to ensure appropriate material properties with the forming process to adopt desired geometries. In particular, in HFQ processes, heat treatable aluminium sheets are heated to a solution heat treatment (SHT) temperature, hot stamped and subsequently quenched in cold dies. After cooling in the cold die, an artificial ageing process is then applied in order to increase the post-form strength of the part.

The HFQ-process mentioned above was initially developed based on traditional aluminium alloys in heat treated conditions, which require long processing times to get the material fully aged. However, this is particularly inefficient when the forming process is integrated with the heat treatment process, as it is not beneficial to have long waits within the production line. This long ageing process effectively reduces the benefits that can be obtained from HFQ processes.

In particular, compared to the HFQ forming processes, the time for conventional artificial ageing (usually 8-10 hrs for the aluminium alloys in the 6xxx series) is relatively long. In addition, components formed by HFQ processes in complex-shapes take much more space than coiled sheets. As a result, there is a lower limitation placed on the number of parts that may be aged within a given furnace at one time. Thus when the as-formed parts are ready to age, the ageing furnace may still be occupied by parts from earlier processes.

Given the same number/configuration of furnaces, much time would be wasted by waiting for the furnace space to become available, which causes poor productivity and makes the process impractical for high volume production. One solution might be to increase the volume of each furnace or provide a greater number of furnaces to increase the ageing capacity of the overall production line. However, such an approach would require significant financial investment.

Moreover, even if issues of capacity are addressed, the long duration of conventional artificial ageing means significant energy consumption and associated costs.

There is therefore a desire to improve the efficiency of processes for treating materials such as metal alloys (and in particular aluminium alloys), especially in the context of HFQ processes used for forming parts during a manufacturing process.

SUMMARY

According to a first aspect of the disclosure, there is provided a method for artificially ageing a material, comprising heating the material according to a predefined temperature profile, wherein the temperature profile comprises a variable target temperature; and applying a paint bake cycle to the material.

By integrating the paint bake cycle into an ageing process, a more efficient method can be provided since the paint bake cycle is required in many manufacturing processes. In general terms, a pre-ageing treatment integrated paint bake process is proposed as a fast ageing method to replace the conventional ageing process. Instead of ageing under a constant temperature as in the conventional method, the proposed method uses a varying target temperature profile during the step of heating the material (pre-ageing heat treatment). For example, this step may comprise two temperature steps or a gradually changing temperature route. The method was designed based on comprehensive understanding of precipitation nucleation and growth mechanisms. The principle is to enable fast and finely dispersed nucleation at a low temperature (energy) level and rapid growth of nucleus into a desired phase at a high temperature (energy) level, which is applicable to any heat treatable aluminium alloys.

In preferred embodiments, the predefined temperature profile comprises a first period and a second period and the target temperature during the second period is a constant. In preferred embodiments, the target temperature during the second period exceeds the target temperature during some or all of the first period. The second period may be designed to encourage the rapid growth of the dispersed nucleation achieved during the first period. The second period may follow the first period and may begin directly after the first period or with some separation between periods. The second time period may be short and indeed may be instantaneous.

Preferably, the target temperature during the second period exceeds the Guinier-Preston solvus temperature. The target temperature during the second period may also be less than the target phase solvus temperature. Appropriate selection of the target temperature during the second period may assist in the desired ageing results. In some preferred embodiments, the target temperature during the second period is in the range 180° C. to 270° C., more preferably 180° C. to 240° C. In a particular preferred embodiment, the target temperature during the second period is 210° C.

Optionally, the target temperature during at least part of the first period is less than the Guinier-Preston (GP) solvus temperature. The target temperature during the first period may always be less than the GP solvus temperature or may vary such that at some points it exceeds this temperature. Appropriate selection of the target temperature during the first period can ensure that nucleation is successful. In particular, the target temperature during the first phase can be selected for optimum density and size of the nuclei.

In some preferred embodiments, the target temperature during the first period is constant. A constant temperature may be optimally selected for the desired ageing process. The constant target temperature may be in the range 50° C. to 130° C., more preferably 70° C. to 110° C.

In other preferred embodiments, the target temperature during the first period is variable. For example, the target temperature during the first period may continuously increase until it is equal to the target temperature during the second period. It is found that this approach is practical in large scale furnaces to offer temperature control without overheads associated with discrete switching events while at the same time offering an improved ageing process over conventional methods. In some embodiments, there is no requirement for a second period following the first period.

The duration of the first period is preferably at least equal to the duration of the second period. In preferred embodiments, the duration of the first period may be greater than the duration of the second period, preferably at least two times greater than the duration of the second period and more preferably at least three times the duration of the second period. This approach has been found to offer significant benefits.

In preferred embodiments, the paint bake cycle is applied subsequent to the heating step. In this way, the paint bake cycle can be arranged to result in a peak aged material.

The material is preferably an aluminium alloy, particularly a heat treatable aluminium alloy. In a particular preferred embodiment, the material is an aluminium alloy in the 6xxx series (as defined by the International Alloy Designation System) but may also be in the 7xxx series or the 2xxx series, for example. In preferred embodiments, the alloy comprises aluminium, magnesium and silicon but it may additional or alternatively comprise one or more further elements. The material may be formed using a solution heat treatment cold die forming and quenching process.

According to a further aspect, there is provided a method for artificially ageing a material, comprising heating the material according to a predefined temperature profile, wherein the temperature profile comprises a variable target temperature, wherein the target temperature increases during a first period until it reaches a constant target temperature applied during a second period. Preferred features of the first aspect may apply equally to the second aspect.

In a further aspect, there may comprise a method for fabricating a component, comprising forming a material into a desired geometry and then carrying out the method of either the first or second aspects. The step of forming may comprise heating the material. The step of forming may be a solution heat treatment cold die forming and quenching process.

The disclosure provides a method that can relate to an efficient fast ageing procedure applied to Solution heat treatment cold die forming and quenching process (HFQ) (described in GB patent application GB2473298 and international patent application WO 2010/032002 A1) manufacturing process of as-formed aluminium-alloy components to achieve high strength. It can integrate a fast pre-ageing treatment with a paint bake cycle which is often applied in automotive production lines. The pre-ageing treatment can be a two-step pre-ageing or a duplex pre-ageing. For two-step pre-ageing, the procedure is to firstly heat the as-quenched aluminium-alloy to a temperature below Guinier-Preston (GP) zone solvus temperature, providing energy to form finely dispersed nucleus. The aluminium-alloy is then heated to a higher temperature to obtain the pre-peaked ageing state. For duplex pre-ageing, the procedure is to heat the as-quenched aluminium-alloy gradually until the optimum temperature between GP zone solvus temperature and target phase solvus temperature is attained. The temperature is then held for a certain time to generate a pre-peaked ageing state. Following pre-ageing the paint bake process is applied, which allows further exploitation of ageing potential and generation of desired condition of the alloy (e.g. peak aged T6).

BRIEF DESCRIPTION OF THE DRAWINGS

Embodiments of the present disclosure will now be described with reference to the accompanying drawings, in which.

DETAILED DESCRIPTION

Figure 1:
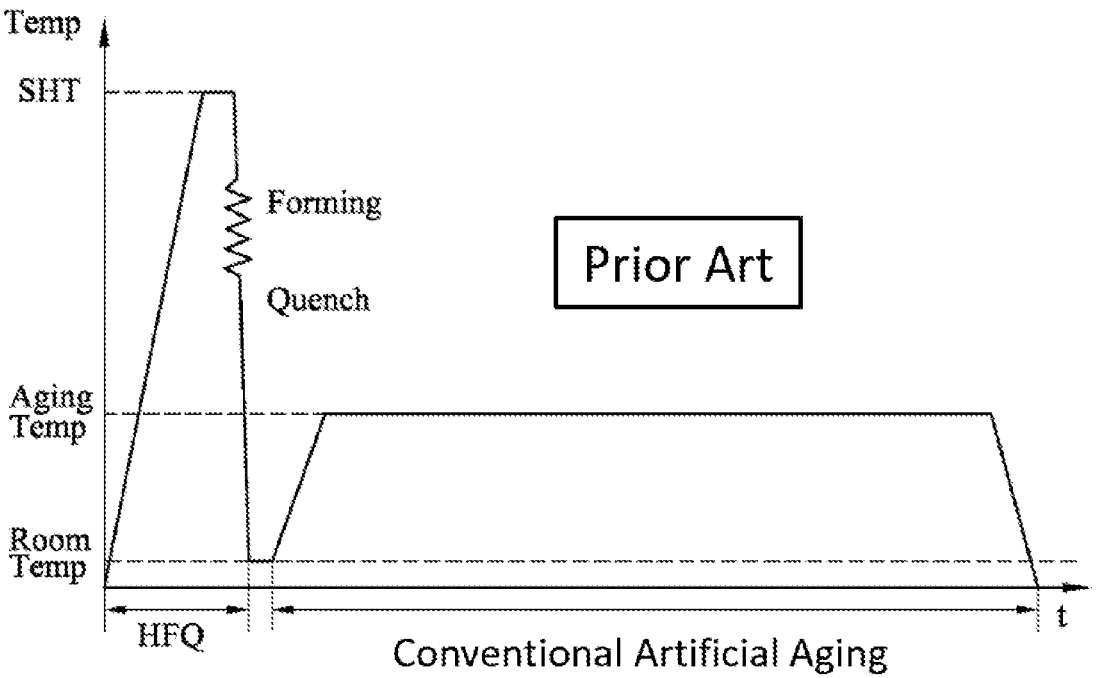
FIG. 1 is a schematic representation of the temperature profile for a HFQ process and subsequent conventional artificial ageing.

Referring to FIG. 1, a solution heat treatment cold die forming and quenching process (HFQ) is schematically illustrated with a conventional ageing process subsequently applied. As can be seen during the HFQ process, the temperature is raised to a solution heat treatment temperature (SHT). The material is then hot stamped and subsequently quenched in cold dies.

The conventional artificial ageing process is then applied. A fixed target temperature is chosen for the entire duration of this process as the now-formed material is placed in a furnace. The ageing process typically takes a number of hours (around 9 or 10) to complete and represents a significant barrier to efficient implementation of such processes.

In FIG. 1, the material is an aluminium alloy. Such alloys have particular benefits in many manufacturing processes, such as the construction of vehicles. In order to appreciate the benefits of the present disclosure, the precipitation mechanisms and process design for AA6xxx (which is the most widely used aluminium alloy series in car-body structures) are discussed in detail below.

Age hardening is a process that enables a super saturate solid solution (SSSS) to gain enough driving force to grow to finely dispersed β", which is considered to be the main hardening phase of the 6xxx series aluminium alloys. The sequence of the phase revolution is as follows: SSSS→co-clusters→Guinier-Preston (GP) zones (I)→GP zones (II)/β"→β'→β. Co-clusters are formed by Mg and Si in the aluminium matrix with un-defined structure. When co-clusters grow further, GP zones will emerge with a spherical structure within Al-matrix. β"-phase, with the composition of MgSi, has been proved as the peak aged condition for the highest post strength of material. This is because the size of β" is big enough to provide high strength resistance for dislocations to cut, and appropriately small to avoid bowing. However, ageing for a longer time will pass the material through the β"→β'→β phases, which would induce over-ageing and thus a reduction in strength. Optimum temperatures and time ranges corresponding to the formation of different phases can be illustrated by temperature-time-transition (TTT) curves.

Figure 2:
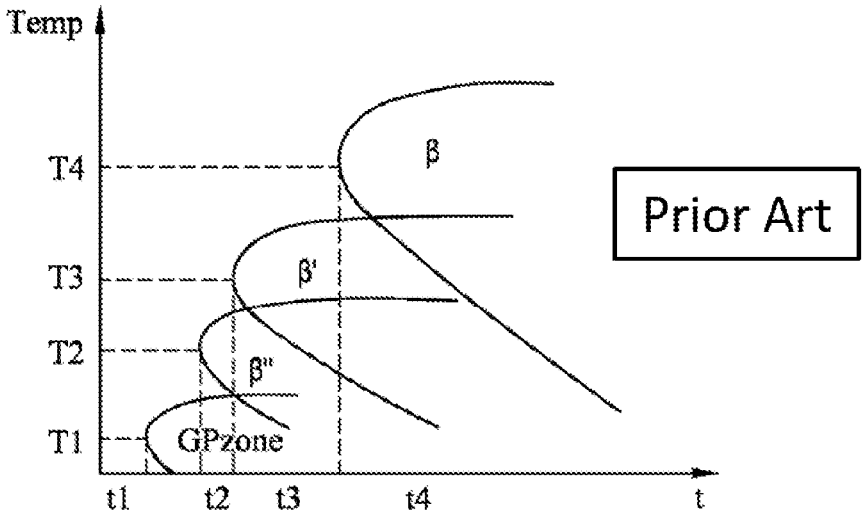
FIG. 2 is a schematic illustration of TTT curves for precipitates of a 6xxx series aluminium alloy.

FIG. 2 schematically shows the TTT curves of precipitates in a typical heat treatable aluminium alloy. T1, T2, T3, T4 represent optimum temperatures for GP zone, β", β' and β to nucleate and grow. Higher energy, provided by a higher heat treatment temperature, will result in faster growth but a lower dispersion of precipitates. A reasonable ageing scheme should allow a good balance of precipitates in density and size.

Figure 3:
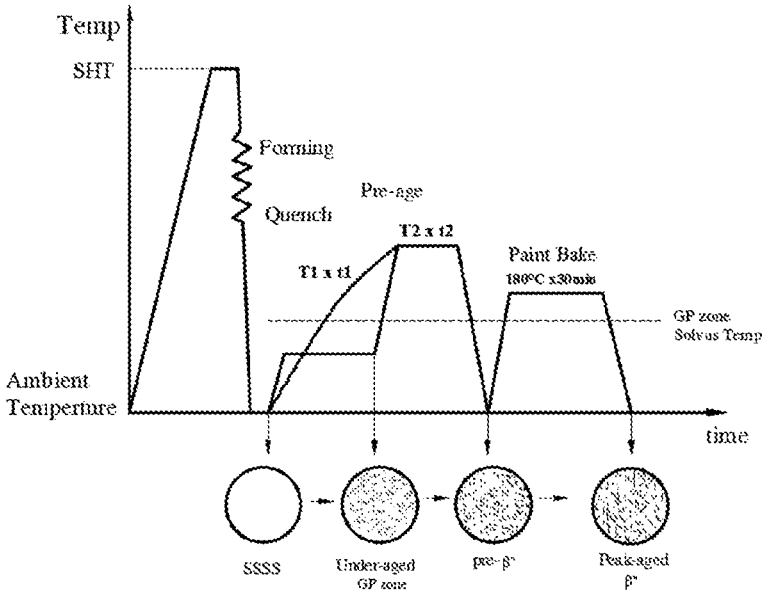
FIG. 3 is a schematic illustration of the fast ageing method and microstructural evolutions.

Schematic temperature profiles of the fast ageing method are given in FIG. 3. Prior to the ageing treatment, a solution heat treatment such as HFQ is applied to create a formed material (such as an HFQ formed material). Subsequently, two steps of heat treatment with different holding temperatures are provided before paint baking, which is denoted the two-step pre-ageing treatment. The first step (T1×t1) is to control the temperature below GP zone solvus temperature, providing GP zone the appropriate low energy to nucleate quickly and with adequate dispersion. The second step (T2×t2) is to supply material at a much higher level of energy, so that GP zones formed in the first step can grow rapidly to the main hardening phase β". (T1×t1) and (T2×t2) represent the holding temperature and time for the first and second steps, respectively. They should be well defined to make a positive effect on the paint bake response and enable the material to be peak-aged. Since the two steps of pre-ageing interact, an optimum trade-off should be found between (T1×t1) and (T2×t2). If the GP zones formed in the first step are too small, they will dissolve during the second heating step. Moreover, instead of providing nuclei, the small GP zones will be detrimental to the ageing process. This is because small GP zones can absorb enough energy to dissolve during the second step and occupy a fraction of ageing energy when forming β". Therefore, GP zones formed in the first step should be big enough to pass through T2 and act as nuclei to grow rapidly to reach β". At the same time, T1 should not be too high, since high temperature will result in a reduction in the density of precipitates. The microstructural evolutions are also schematically illustrated in FIG. 3.

The two-step pre-ageing requires transport of HFQ formed components into two furnace chambers. To simplify the operation, a "duplex" pre-ageing treatment is proposed and the temperature profile is shown by the dashed curve in FIG. 3. By heating the material slowly during a first period to a constant target temperature for a second period, a good balance between the precipitation density and growth can still be achieved. Therefore only one final target temperature is required. This kind of treatment makes the industrial implementation easier and more practical.

Several advantages of the fast ageing method are listed below:

1. By obeying the precipitation mechanism mentioned above, the desired condition, e.g. peak aged, can be obtained with a much shorter time and this is certain to increase productivity.
2. Due to the reduction in ageing time, energy is significantly saved.
3. Reduction in time also means that potentially smaller furnaces can be used when achieving the same production cycle rate. Industry can benefit from easier and cheaper purchasing and setting up of these facilities.
4. By applying duplex pre-ageing treatment, the ageing process is further simplified and easier to implement.
5. Paint bake cycle is utilized as an ageing process to further save energy.

All the above advantages will result in great economic savings without sacrificing mechanical properties of the products.

Example Aluminium Alloy—AA6082

With reference to FIG. 3, an embodiment of the fast ageing method for a specific 6xxx alloy (AA6082) will now be described. Both two-step pre-ageing and duplex pre-ageing, integrated paint bake, have been implemented to heat treat AA6082-SSSS state.

Referring to FIG. 2, a series of critical temperatures ranges of AA6082 are given: The most efficient temperature range for GP zones to nucleate is 70-110° C. (T1), for GP zone to grow to peak-aged state β" is 240-250° C. (T2), and for a further increase in precipitate size to generate overaged state β' and β is 290-320° C. (T3) and 450° C. (T4), respectively. Based on these, heat treatment experiments were designed and conducted to optimize the pre-ageing conditions.

Two-Step Pre-Ageing Process

For the two-step pre-ageing process, the alloy (AA6082-SSSS) is firstly subjected to the GP zone formation temperature (conditions defined from 50° C. to 130° C.), with a first, holding period (conditions defined from 0 mins to 60 mins). Then transfer to the β" growth temperature (conditions defined from 220° C. to 270° C.) for a period (conditions defined from 15 mins to 55 mins), followed with a simulated paint bake process (180° C.×30 mins). Orthogonal experiments have been conducted. In order to evaluate the heat treatment conditions, hardness and strength were measured. By comparing with post strength of the alloy aged in a conventional process, the optimum condition was determined.

Duplex Pre-Ageing Process

For the duplex pre-ageing process, a gradual heating was applied to the alloy (AA6082-SSSS). Testing conditions in terms of heating time and holding temperature were designed, with heating time (i.e. a first period during which the temperature increases) ranging from 10 mins to 30 mins, and a target temperature for a holding period (i.e. a second period subsequent to the first period) ranging from 180° C. to 270° C. Similarly, orthogonal experiments were conducted and the optimum condition was determined according to post hardness and strength.

Compared with the conventional ageing process of AA6082 (190° C.×9 hours), a reduction in time of ~91% for the two-step pre-ageing process and ~96% for the duplex pre-ageing process have been achieved, with >90% of the post hardness and strength guaranteed.

Further Experimental Results

Figure 4:
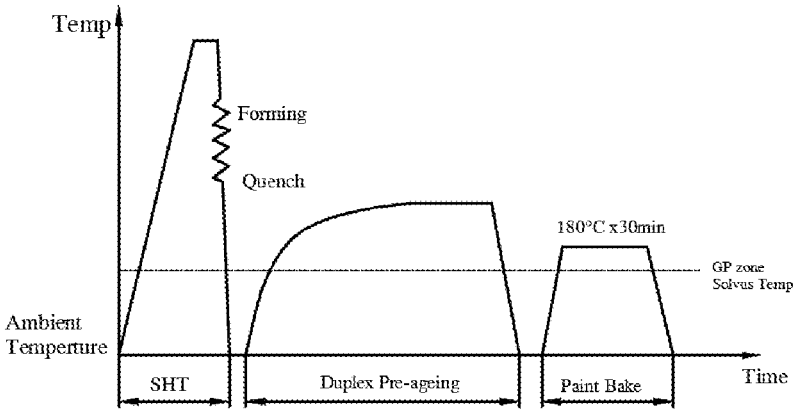
FIG. 4 is a schematic illustration of a process comprises a duplex ageing step.
Figure 5:
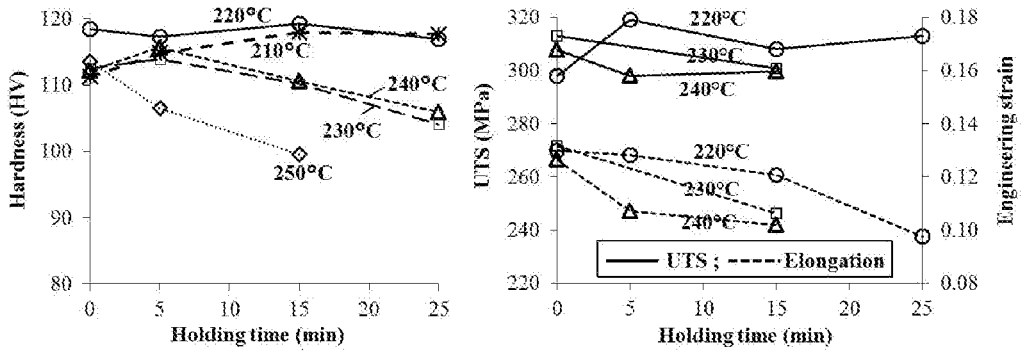
FIG. 5 shows post mechanical properties, (a) hardness and (b) ultimate yield strength (UTS) and elongation, against holding time at different duplex ageing temperatures.
Figure 6:
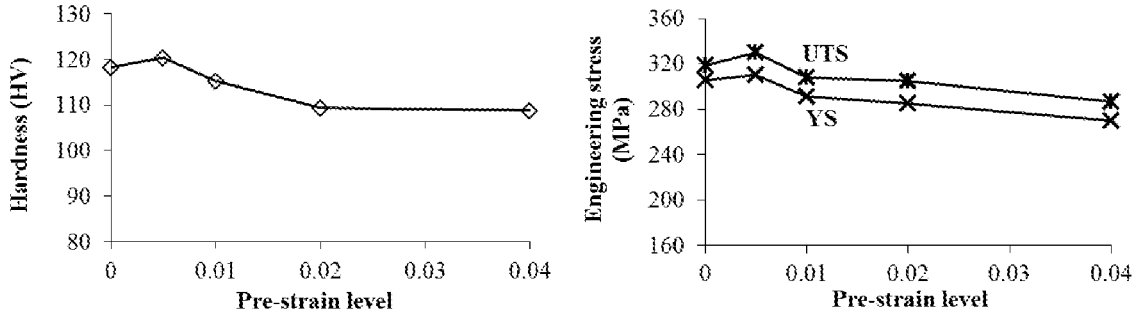
FIG. 6 illustrates effects of pre-deformation on precipitation hardening: (a) post hardness and (b) post strength, showing ultimate tensile strength (UTS) and yield strength (YS).

Further details of experimental results will now be presented with reference to FIGS. 4 to 6. These experiments were carried out using a duplex ageing process together with a paint bake following an SHT process designed to match HFQ conditions. Commercial grade AA6082-T6 sheets with a hardness of 120 HV were used as the material. The test piece was designed as a standard uniaxial tensile specimen, following the sub-size dog-bone shape defined by the American standard test method (ASTM). The dimensions of the gauge section were 6 mm×25 mm (1.5 mm in thickness).

The designed procedure to be applied to the test specimen is schematically illustrated in FIG. 4. The specimens were solution heat treated (fast heating to a 530 C×2 min soaking) and quenched prior to ageing. The tests can be divided into two groups: (I) Different heating periods, different holding temperatures and times were defined to identify the optimum ageing conditions; (II) quenched specimens were stretched to different strain levels to simulate the pre-deformation of HFQ processes, and then aged under optimum conditions identified in (I). After the duplex ageing step, all specimens went through another step under the thermal conditions of a paint bake cycle (180 C×30 min). Post mechanical properties of heat treated specimens were evaluated by hardness testing and uniaxial tensile testing.

Heat treatments were conducted using laboratory chamber furnaces. K-type thermocouples were attached to the specimens to monitor the temperature using a thermal data logger. Vickers hardness (HV) of specimens was tested using ZHU hardness testing machine, with 5 kg loading force. Tensile tests were conducted using an INSTRON material testing machine (Model 5584), with extensometer for strain measurement.

It was found from resting results that, for the duplex ageing, the influence of gradual heating time (i.e. length of a first period of the temperature profile) in the range of 10-20 min was not sensitive on ageing conditions and material post properties. Thus the heating time was fixed as 15 min, with subsequent holding conditions altered for optimisation. FIG. 5 shows the post mechanical properties of material aged under different conditions. The hardness dropped with increasing holding time (i.e. the length of the second period after the first period) for the ageing temperatures of 250° C., 240° C., and 230° C., which implies over-ageing of the material. This is also exhibited by the trend of ultimate tensile strength (UTS). Adversely, for 210° C., an increasing trend of hardness is shown, which means a certain holding time was needed to allow peak-ageing to be achieved after paint bake. Considering the post properties of material and the stability of the process, 220° C.×5 min was determined as the optimum holding condition. However, it should be recognised that the holding period may be instantaneous (that is a period length of zero). The total processing time of duplex ageing process prior to paint bake would be 20 min only.

A concern for artificial ageing of HFQed parts is the uniformity of final strength distribution. The ageing response of formed components could be affected by the degree of dislocation density generated during forming, which has to be investigated. It is noted that, as the specimens were deformed at room temperature, the level of strain should be much smaller than hot formed strain to represent the same degree of dislocation density. As shown in FIG. 6, under the optimum ageing condition defined above, the precipitation hardening increased with a small pre-strain level up to 0.005 and decreased with further straining until became stable. The cause of the phenomenon can be explained as: dislocations generated by pre-deformation could provide point defects as nucleation sites and reduce the requirement on activation energy for precipitates to form and grow. Thus the precipitation hardening could be enhanced. However, with further reduction in required activation energy due to increasing dislocations, the material could be over-aged. When the dislocations in the aluminium matrix gradually became saturated, the hardness and strength of the material tended to approach constant values. For the studied alloy, 90% of the full hardness and strength were guaranteed.

Variations and modifications will be apparent to the skilled person. Such variations and modifications may involve equivalent and other features which are already known and which may be used instead of, or in addition to, features described herein. Features that are described in the context of separate embodiments may be provided in combination in a single embodiment. Conversely, features which are described in the context of a single embodiment may be also provided separately or in any suitable sub-combination.

The work leading to this invention has received funding from the European Union Seventh Framework Programme (FP7/2007-2013) under grant agreement no 604240.

The invention claimed is:

1. A method of pressing a formed component from a sheet material, comprising forming a material into a desired geometry, the method including artificially ageing the formed component, wherein the material is a heat treatable aluminium alloy, wherein the formed component is formed using the method by sequential steps of being heated to its solution heat treatment temperature, then being formed into the desired geometry by being hot stamped once, and subsequently being quenched in cold dies, wherein, after forming of the formed component, the formed component is artificially aged using an ageing method which comprises the steps of:

(a) applying a pre-ageing heat treatment by heating the formed component according to a predefined temperature profile, wherein the temperature profile comprises a varying target temperature; and, subsequently, (b) applying a paint bake cycle to the formed component, and wherein the predefined temperature profile of step (a) comprises a first period and a second period, wherein the target temperature during the first period is a constant target temperature in the range 50° C. and 130° C., or wherein the target temperature during the first period is a variable target temperature which is less than the Guinier-Preston solvus temperature, wherein the target temperature during the second period is between 180° C. and 270° C., the target temperature during the second period is constant and the target temperature during the second period exceeds the Guinier-Preston solvus temperature, wherein the first period has a duration of less than 60 minutes, wherein the ageing method increases a post-form strength of the formed component; and wherein the ageing method results in a post-form yield strength of the formed component of greater than 240 MPa.

2. The method according to claim 1, wherein the target temperature during the first period is constant.

3. The method according to claim 1, wherein the target temperature during the first period continuously increases until it is equal to the target temperature during the second period.

4. The method according to claim 1, wherein, when the target temperature during the first period is a constant target temperature in the range 50° C. to 130°° C., the total combined duration for the first period and the second period is between 15 minutes and 60 minutes, and wherein, when the target temperature during the first period is a variable target temperature which is less than the Guinier-Preston solvus temperature, the total combined duration for the first period and the second period is between 10 minutes and 30 minutes.

5. The method according to claim 1, wherein, when the target temperature during the first period is a constant target temperature in the range 50°° C. to 130° C., the first period has a duration of between 0 minutes and 45 minutes and the second period has a duration of between 15 minutes and 55 minutes, and wherein, when the target temperature during the first period is a variable target temperature which is less than the Guinier-Preston solvus temperature, the first period has a duration of 15 minutes and the second period has a duration of 5 minutes.

* * * * *